US005495622A

United States Patent [19]

Kaufman

[11] Patent Number: 5,495,622

[45] Date of Patent: Mar. 5, 1996

[54] VENTILATED HAT

[76] Inventor: Harold C. Kaufman, 7127 Northampton, Houston, Tex. 77055

[21] Appl. No.: 298,963

[22] Filed: Sep. 2, 1994

[51] Int. Cl.[6] ..... A42B 1/00

[52] U.S. Cl. ..... 2/175.1; 2/181; 2/182.6; 2/209.5; 2/209.7; 2/DIG. 1

[58] Field of Search ..... 2/182.1, 182.6, 2/209.7, 7, 171, 171.4, 171.5, 171.6, 171.7, 181, 175.1, 184.5, 195.1, 209.3, 209.4, 209.5, 425, DIG. 1

[56] References Cited

U.S. PATENT DOCUMENTS

| | | | |
|---|---|---|---|
| 50,285 | 10/1865 | Smith | 2/182.6 |
| 707,784 | 8/1902 | Johnson | 2/182.6 |
| 1,988,101 | 1/1935 | Wittcoff | 2/209.7 |
| 1,990,096 | 2/1935 | Rothchild | 2/209.7 |
| 1,997,708 | 4/1935 | Uriwal | 2/209.7 |

*Primary Examiner*—Diana Biefeld
*Attorney, Agent, or Firm*—Cynthia L. Hunter

[57] ABSTRACT

Disclosed is an all weather runner's hat, the design of which promotes airflow around the head and hair of a person while, at the same time, deflecting rain which comprises a generally hemispherical shell, a brim which is attached at an angle of about 15° from horizontal and varies in width around the circumference, a number of vents positioned in the crown for ventilation, and a means of attaching the headband with spacers to create a novel air gap to allow air flow around the head and hair.

19 Claims, 6 Drawing Sheets

VENTILATED HAT

FIELD OF THE INVENTION

This invention relates to an all-weather hat worn for protection from the elements. More particularly, this invention relates to a hat especially designed for runners and their unique requirements for a head covering which provides protection from the elements while, at the same time, allowing for adequate air flow around the head to prevent overheating.

BACKGROUND OF THE INVENTION

Generally, the only head wear available for runners is sun visors or some form of commonly available hat or cap of the type which has a crown or dome which fits over the crown of the head and has a visor or bill attached to the front thereof, such as, for example, a baseball cap.

Visors offer adequate protection as far as shading the eyes from the sun, but offer little protection from rain. The general category of caps which include baseball caps is usually made of cloth or plastic which can be insulated for warmth, or made partially or wholly of an open mesh material for wear in warm climates where ventilation is desirable. The visor or bill attached to the shell's lower edge extends forward, normally about one and one-half inches to five inches, with about three inches average. The width of the visor or bill is usually about six to eight inches. The purpose of the visor is to protect the wearer's face against snow, wind and sun and, for general purposes, rain.

It is well known among runners that while running the body temperature is significantly elevated and, in the process of cooling the body, much of this heat is released from the head. Therefore, when it is raining a runner wearing a generally available cap or hat may have his face protected from the rain, however, unless the temperature is quite cool, the head will become much too warm, which condition is uncomfortable and undesirable and, sometimes dangerous.

No art is available in this field which would suggest an all-weather hat for runners to wear, especially in the rain, which would have an aerodynamic design particularly suited to a runner's needs and which would provide air flow for cooling around the head, while at the same time, diverting water off the face, hair and back of the neck. Indeed caps now available for runners do not divert water off the back of the neck. The only hats which would cover the back of the neck would be, for example, a fireman's hat, but that would be much too heavy and cumbersome for a runner. Also, most caps and hats tend to flatten the hair of the runner; and allow it to become soaked with perspiration.

SUMMARY OF THE INVENTION

In accordance with certain of its aspects, this invention is a novel aerodynamic all-weather hat to wear, particularly in rainy weather, while running, exercising, or engaging in activities which elevate the athlete's body temperature which generally comprises a shaped crown or dome shell, having a lower edge which fits over the upper portion of the head of a person; a front visor, attached to that section of the shell lower edge which contacts the forehead and extends outwardly therefrom; a rear brim which is attached to that portion of the shell lower edge which contacts the back of the head and neck; a head band of the type for absorbing perspiration attached to the inside of the lower edge of the shell for the entire circumference; and, on the dome, at a point generally between the lower edge and crown are slits or vents in the hat, evenly spaced around the circumference, protected by overhanging flaps of material, such that air can flow in, but rain would be deflected. The vent holes or slits are optionally covered with a mesh type material. This hat minimizes the flattening and soaking with perspiration of the wearer's hair.

DETAILED DESCRIPTION OF THE PREFERRED EMBODIMENT

Figure 1:
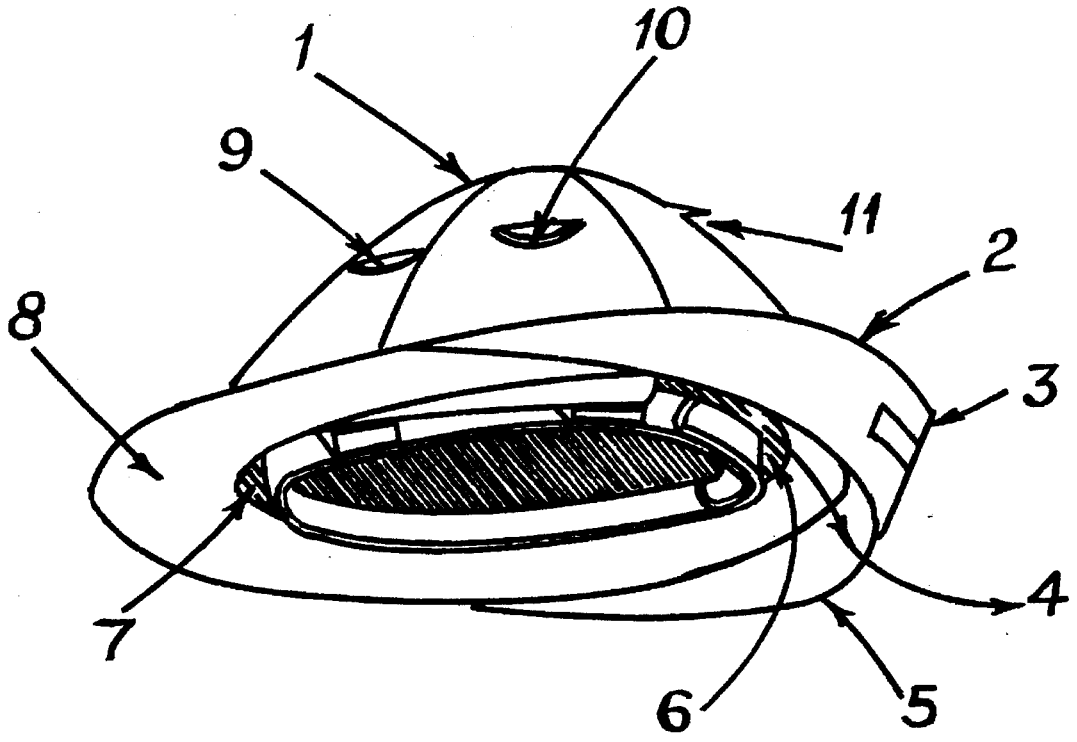
FIG. 1 is a side view, partially tilted to reveal the position of the headband.

Referring now to the drawings, FIG. 1 shows the all-weather runner's hat. This hat has a generally domed shaped crown 1, slightly angled toward the rear, which fits over the upper portion of the head. The visor, 8, extends about 1 to 4 inches, preferably about 2 inches. The visor is the front portion of the brim which runs around the crown, sloping upward from front to back at about 15° from horizontal so that air flow pushes the hat onto the head and does not blow the hat off the runner's head. The cap shell is made of lightweight, rain repellant materials, such as, for example, cotton, nylon, canvas or broadcloth treated with water repellant, materials, such as, for exampleSUPPLEX®or GORETEX®. SUPPLEX® is a trademark name for a lightweight nylon type frabric manufactured by E. I. DuPont De nemours and Co. of Wilmington, Del. GORETEX® is a trademarked name for a brand of polytetrafluoroethylene manufactured by W. L. Gore and Co. The use of MYLAR®, TYVEK®, or similar compositions would be within the concept of this invention. MYLAR® is a trademarked name for polyester film made by DuPont de Nemours, E. I. and Co. TYVEK® is a trademarked name for a spunbonded olefin obtained commercially from DuPont. The hat could also be constructed of colored or transparent lightweight plastic. The plastic could be pliable like fabric or molded. A composition such as Neoprene could also be envisioned. Another possible material to employ is straw.

The runner's hat can be any color or it can be transparent. Where white materials or fabric are used the hat would have desirable sun or heat reflective properties in addition to the aerodynamic and air flow properties discussed herein. Silver or aluminum materials could also be used for their reflective properties. Although white or light colors would have heat reflecting properties, any number of colors, prints, and patterns are suitable.

If the shell is of a soft material, ribs may be used for support. The vents, 9–11, allow for air flow and are comprised of a generally round opening, a slit, or a cut out space in the wall of the hat protected by an overhanging flap bent outward from the surface of the hat. Each vent and flap can be compared to an "eyelid".

The rear brim, 5, is comprised of the top of the rear brim, 2, and the rear brim edge, 3. The top of the rear brim, 2, extends toward the back of the hat and turns downward to form the rear edge, 3. The position of the rear brim, 2, and the rear edge, 3, defines a space wherein the wearer can access the headband, 6, for the purpose of fastening or adjustment. The rear brim also protects the hair and the back of the neck from rain. The angled brim, 8 and 5, and rear edge (FIG. 1, number 3) also provide an esthetically appealing aerodynamic appearance not found in other hats. The cutaway reveals a headband (Also see FIG. 3, No. 23) inside around the entire circumference of the lower edge of the shell. The headband is mesh or other perspiration absorbant material, and fastens at the back, 6, with hook and loop fastener or other appropriate fasteners. Examples of suitable fasteners include, but are not limited to, snaps, buckles and clamp buckles. The headband can also be one piece, comprising, for example, stretchable or elastic containing terry-cloth or mesh with foam plastic backing.

Figure 6:
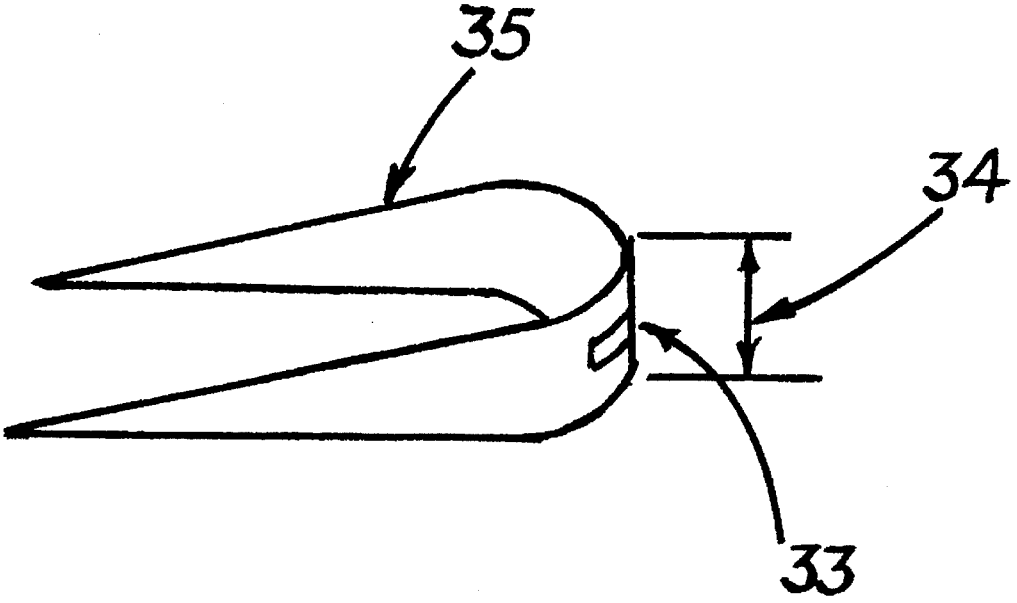
FIG. 6 is an enlargement of the rear brim.

An enlargement of 3 is shown in FIG. 6. The design of the hat allows for air flow outward at 9, 10, 11 and 4, as well as at vents situated on the side not visible in FIG. 1.(See FIG. 2, No. 15). The vents positioned around the circumference of the crown may be covered with a material through which air can flow, such as, for example, net or mesh. Air flows in at 8 and, in addition, there is an air gap or air space on the inside between the hat and headband, 7, to allow for air flow over the head, thus minimizing flattening of the hair and soaking of the hair with perspiration.

Figure 2:
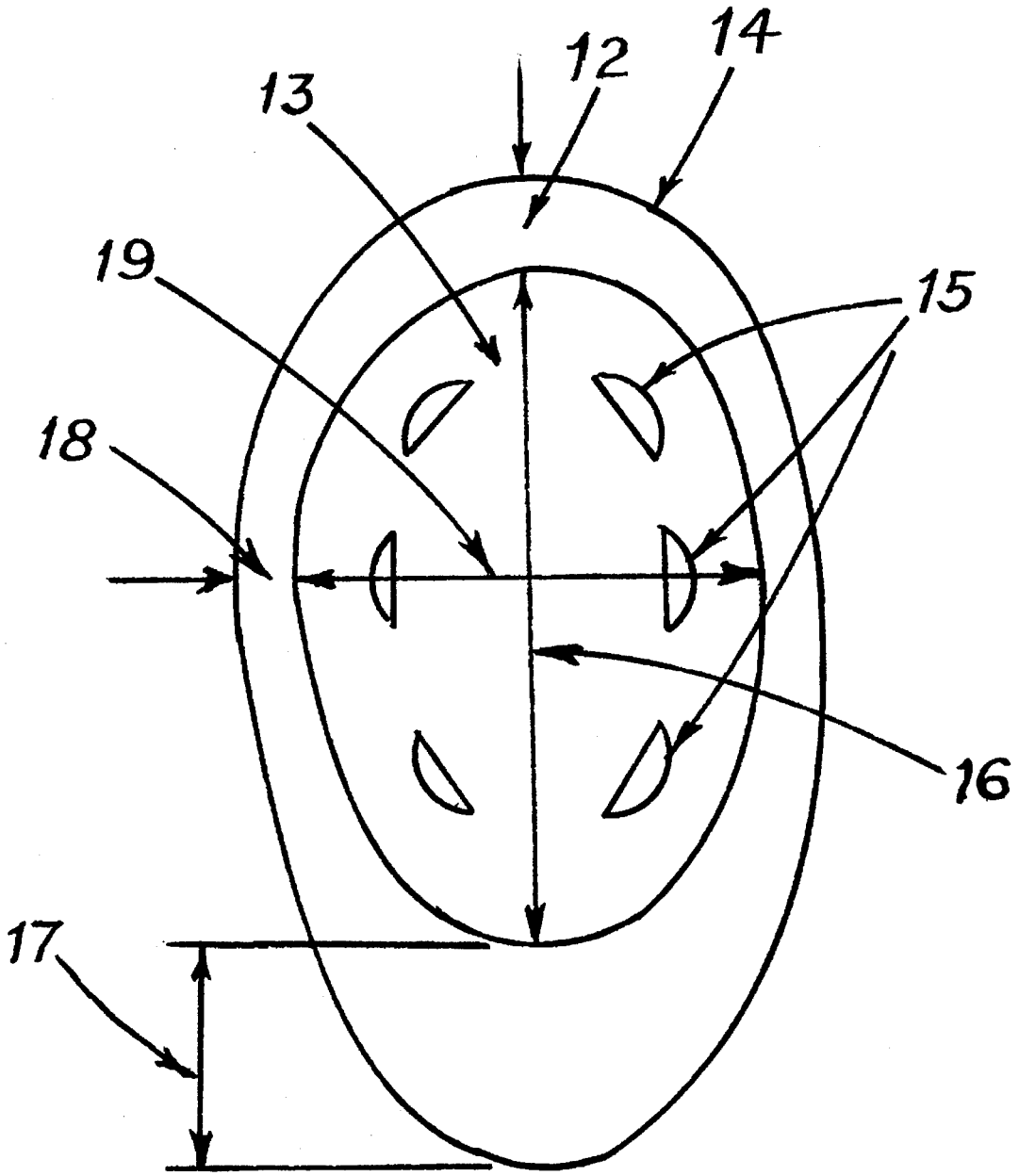
FIG. 2 is a top view of FIG. 1.

FIG. 2 shows a top view of the hat. The visor, 17, is 1 to 4 inches at the front and ½ to 2 inches on the side, 18. The rear brim, 14, is 1 to 3 inches (12). Said brim which entirely encompasses the hat, though not the same width at all points, can be stiffened with cardboard, light plastic backing, or other similar materials. Straight through the crown from front to back, 16, is about eight to ten inches, preferably about 8½ inches. The distance from side to side, 19, through the highest part of the crown would be about six inches to nine inches, preferably seven inches.

The vents, 15, in FIG. 2, are similar to the structure of an eyelid and are four or more in number. The vents are shielded by the overhanging flap structure.

Figure 3:
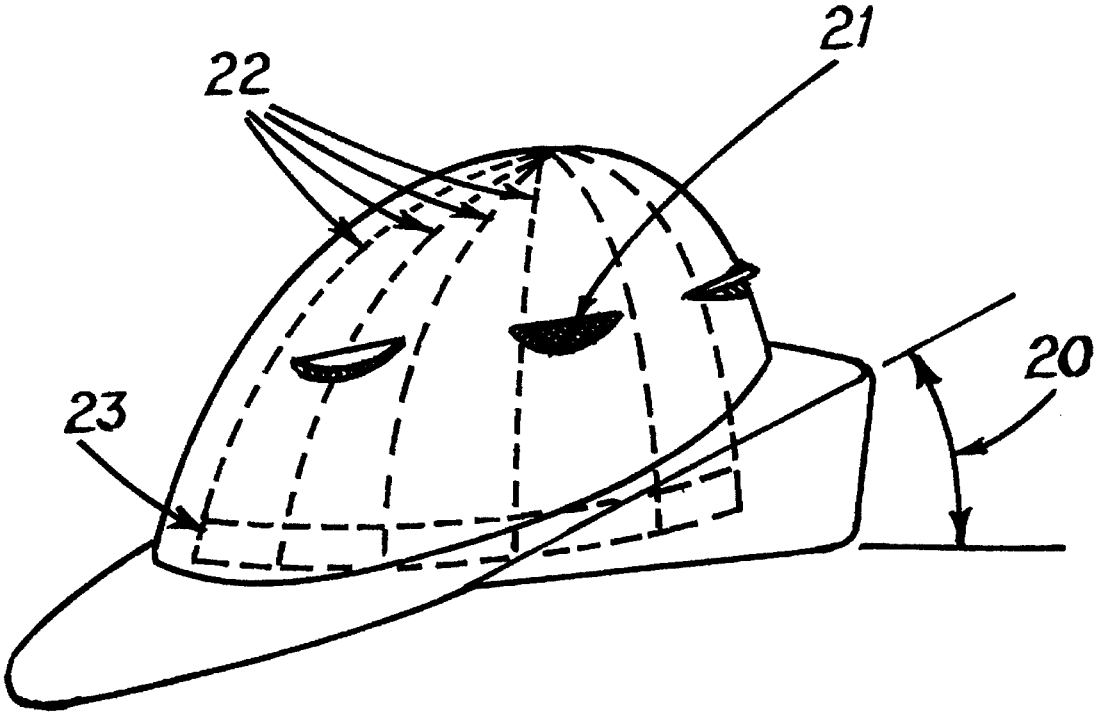
FIG. 3 is a broken line side view showing the position of the ribs inside the crown.

FIG. 3 is a side view, partially broken away. Number 20 indicates the angle of the brim from horizontal. This angle is from about 5 to 30 degrees, preferably about 15 degrees. Number 21 shows how the vents would appear underneath the overhanging lid or flap. These openings can be covered with mesh or net type material. Number 23 shows the position of the headband inside the hat. Number 22 indicates the position of evenly space ribs inside the crown of the hat.

Figure 4:
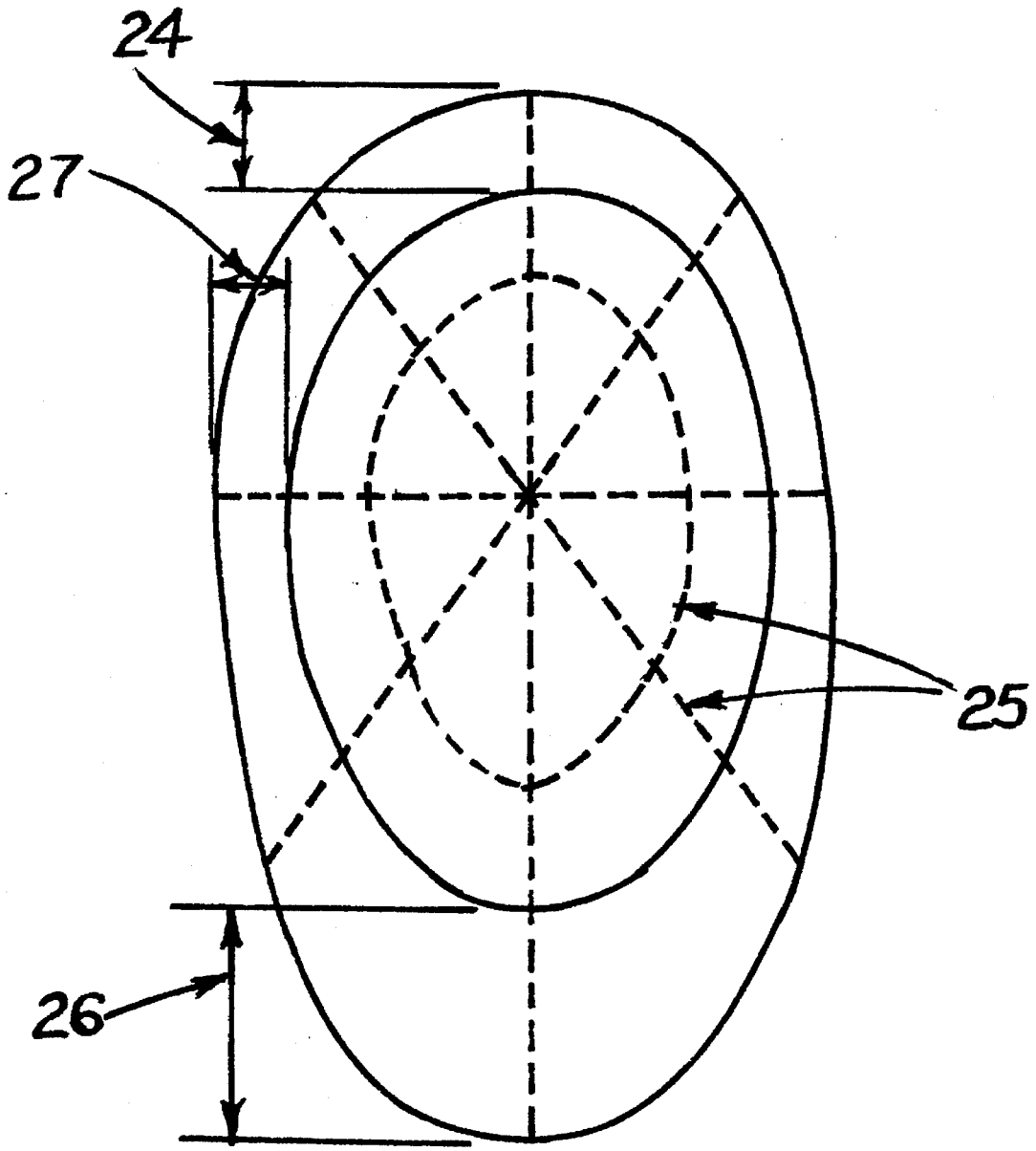
FIG. 4 is a top view of FIG. 3.

FIG. 4 is a top view of the hat. The width of the rear brim, 24, is 1 to 3 inches, preferably 1½ to 2 inches. The dotted lines, 25, represent the position of ribs inside the hat. The width of the front brim, 26, is about 1 to 4 inches, preferably 3 inches. The width of the brim on the side, 27, is about ½ to 2 inches, preferably 1 inch, however the width of the side brim can be as narrow as ¼ of an inch.

Figure 5:
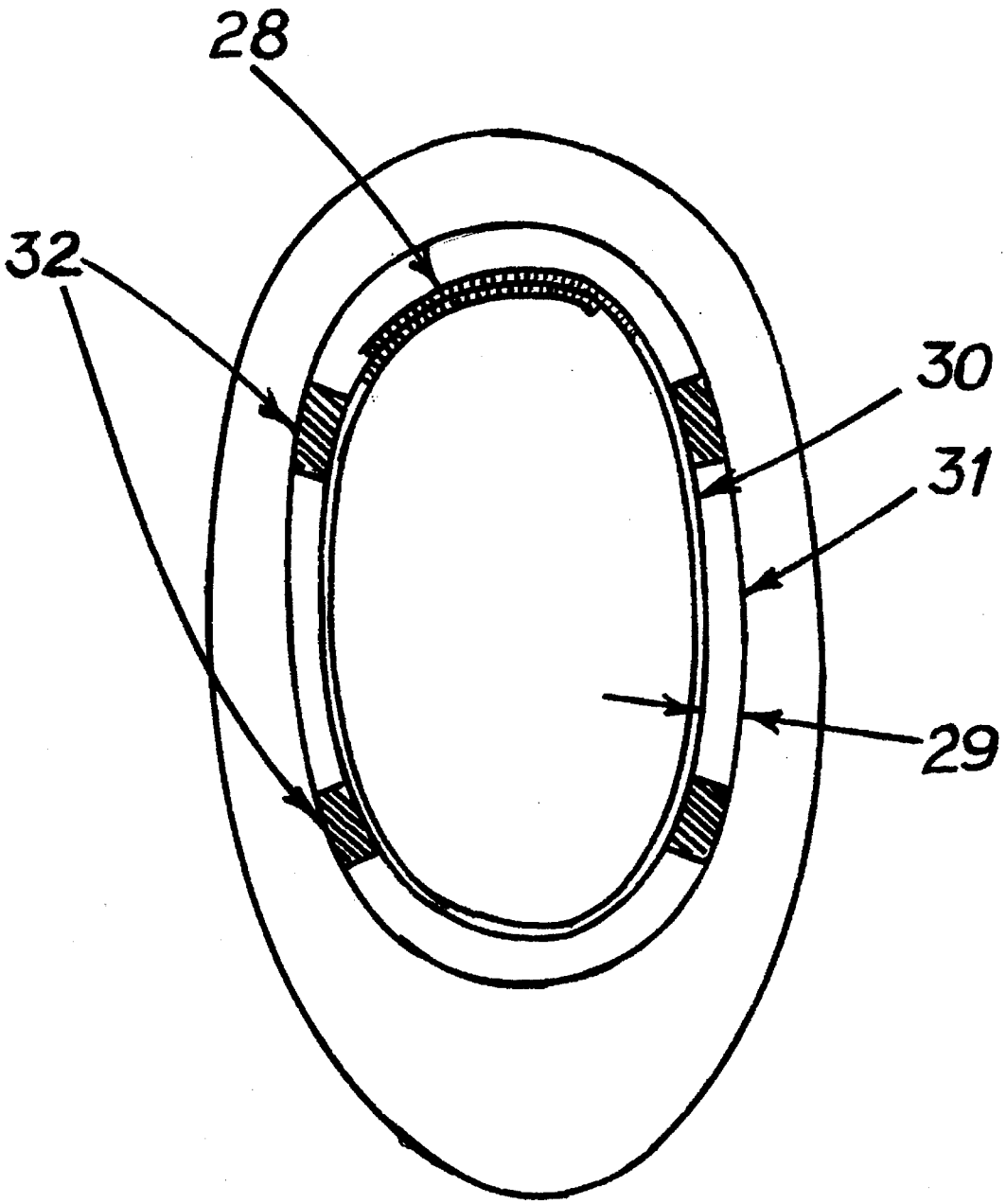
FIG. 5 is a bottom view which reveals a space between the lower edge of the shell and the headband.

FIG. 5 is a partial view of the hat from the bottom, looking at the inside of the crown, which, again, shows the space running around the circumference on the inside lower brim, referred to in FIG. 1, number 7. Number 28, adjacent to the space at the rear of the hat, represents the position of hook and loop fastener tabs which overlap to adjust the headband for snug fit for various head sizes. As mentioned above, other types of fasteners may be used.

FIG. 5 shows the air gap of FIG. 1, number 7 from a bottom view, 29. This figure shows the position of the air space in proximity to the headband situated on the lower edge of the crown. The air space is between the headband and the lower inside edge of the crown and runs around the entire circumference of the hat. The headband is represented by 30 and the lower edge of the crown of the hat by 31, with the air gap, 29, between. The air space allows air to flow around the head, while the headband holds the hat firmly in place. The air space between the inside of the lower edge and the headband is from ¼ to 1 inch, preferable ½ inch. The headband is made of a sturdy, but perspiration absorbant material. The headband is attached to the inside lower edge of the shell by use of sufficient spacers, evenly placed around the circumference in the air gap. About 3 to 8 spacers should be sufficient, preferably about 4 to 6 would be desirable. Foam rubber, or other flexible materials may be used for the spacers.

FIG. 6 is an enlarged view of the rear edge of the rear brim. A label can be situated at 33. The rear edge, at its widest point at the back of the hat, 34, is 1 to 3 inches, preferably 2 inches. Number 35 represents the lower edge of the rear brim.

Figure 7:
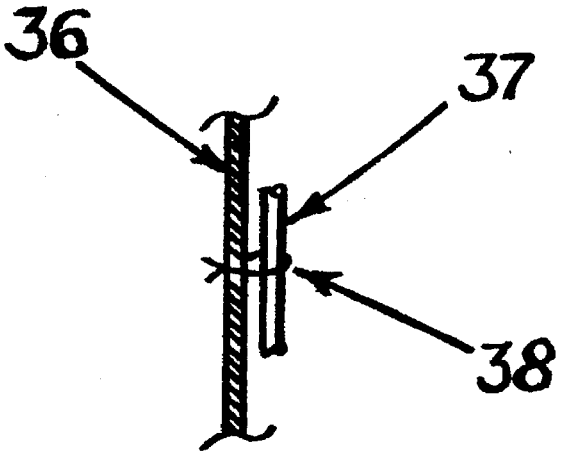
FIG. 7 is an enlargement of the ribs to be used to anchor the material, if the crown is of soft material, which requires support.

FIG. 7 is an enlargement of a rib, 37 (See FIG. 4, no. 25). Loops of thread, metal or plastic affix, 38, or anchor these ribs to material, 36. The ribs are preferable made of plastic or lightweight metal.

The foregoing detailed description has been given for clarity of understanding only and no unnecessary limitations should be assumed therefrom, as modifications will be obvious to those skilled in the art.

I claim:

1. An all-weather runner's hat, the aerodynamic design of which promotes airflow around the head of a person while, at the same time, deflecting rain and other elements wherein the hat comprises:

a. a generally dome-shaped crown which fits over the upper portion of a head wherein the crown has a top and a lower edge and a front and a back, and wherein the lower edge has an inside surface and an outside surface, b. a brim fixedly attached to the lower edge of the crown and extending generally outwardly and perpendicularly therefrom at an angle of about 15 degrees from a horizontal line running from the back of the crown to the front of the crown, said brim varying in width from the front of the crown to the back of the crown, c. 4 to 10 vents positioned around the crown generally halfway between the lower edge and the top of the crown, d. a headband, adjacent the inside of the lower edge of the crown of the hat, extending around the inside of the crown in approximately parallel relation with the lower edge thereof and having a surface facing the inside of the hat and a surface facing the head of wearer when the hat is being worn, e. an air space between the inside lower edge of the crown and the headband which allows air flow in and around the head, f. a rear brim turning downward from a an outermost edge of a portion of said brim which extends rearwardly and outwardly from the lower edge of the back of the crown, said rear brim extending substantially perpendicularly from the horizontal line running from the back of the crown to the front of the crown, and g. 3 to 8 spacers fixedly attached to the inside lower edge of the crown and to the surface of the headband facing the inside the hat.

2. The hat of claim 1 wherein the width of the brim at the front of the crown is in the range of about 1 inch to 4 inches in length.

3. The hat of claim 2 wherein the brim of that hat extends from about 1 inch to 2 inches from the lower edge of the crown at the back.

4. The hat of claim 1 wherein the design of the hat promotes air flow in and around the head.

5. The hat of claim 1 wherein the vents positioned around the circumference of the crown have overhanging flaps.

6. The hat of claim 1 wherein the vents positioned around the circumference of the crown are covered with a material through which air can flow.

7. The hat of claim 6 wherein the vents are covered with a material selected from net or mesh.

8. The hat of claim 1 wherein the headband is made of a material which is perspiration absorbent.

9. The hat of claim 8 wherein the headband is made of a material selected from terrycloth or mesh with foam plastic backing.

10. The hat of claim 8 wherein the headband has an opening at the back thereof which is positioned under the rear brim.

11. The hat of claim 10 wherein the headband opening is fastened with a fastener selected from the group consisting of a hook and pile fastener, snaps, buckles, or clamp buckles.

12. The hat of claim 1 wherein the hat is made of fabric.

13. The hat of claim 12 wherein the fabric is selected from cotton, nylon, canvas, polyester or woven tetrafluoroethylene material.

14. The hat of claim 1 wherein the hat is made of a composition selected from plastic, straw, polyester film, or any suitable lightweight composition.

15. The hat of claim 1 wherein the hat is white.

16. The hat of claim 1 wherein the hat is any color or combination of colors.

17. The hat of claim 1 wherein the hat is made of a fabric or composition characterized by an appearance selected from multiple colors, patterns, prints or patchwork appearance.

18. The hat of claim 1 made of fabric and further comprising 4 to 8 evenly spaced ribs which extend from the top of the crown to equidistant points along the lower edge of the crown, wherein the fabric is attached to the ribs at points around the hat.

19. The hat of claim 18, having fabric attached to the ribs at points around the hat wherein the ribs are fixedly attached to the fabric by means of loops of thread, metal or plastic.

* * * * *